US005885066A

United States Patent [19]

Matsumoto et al.

[11] Patent Number: 5,885,066

[45] Date of Patent: Mar. 23, 1999

[54] SCROLL COMPRESSOR HAVING OIL BORES FORMED THROUGH THE CRANK SHAFT

[75] Inventors: Yoshifumi Matsumoto, Otsu; Shigeru Muramatsu, Kusatsu, both of Japan

[73] Assignee: Matsushita Electric Industrial Co., Ltd., Osaka, Japan

[21] Appl. No.: 807,882

[22] Filed: Feb. 26, 1997

[51] Int. Cl.[6] ..... F04C 18/04; F04C 29/02

[52] U.S. Cl. ..... 418/55.6; 418/88; 418/94; 184/6.18

[58] Field of Search ..... 418/55.6, 88, 94; 184/6.18

[56] References Cited

U.S. PATENT DOCUMENTS 5,533,875 7/1996 Crum et al. ..... 418/55.6

FOREIGN PATENT DOCUMENTS 62-17394 1/1987 Japan ..... 418/94
3-3991 1/1991 Japan ..... 418/55.6
3-242487 10/1991 Japan ..... 418/55.6
5-18387 1/1993 Japan ..... 418/55.6

*Primary Examiner*—John J. Vrablik
*Attorney, Agent, or Firm*—Stevens, Davis, Miller & Mosher, L.L.P.

[57] ABSTRACT

In a scroll compressor, a gas purge bore is formed to extend from an oil bore penetrating a drive shaft of the compressor, causing coolant gas to be expelled out with rising of lubricating oil sucked up by an oil pump through the oil bore. This allows the lubricating oil to rise without undergoing resistance of the coolant gas. By positioning the oil bore close to an oil groove formed in an eccentric bearing, the lubricating oil can be surely supplied to the oil groove.

28 Claims, 5 Drawing Sheets

SCROLL COMPRESSOR HAVING OIL BORES FORMED THROUGH THE CRANK SHAFT

BACKGROUND OF THE INVENTION

1. Field of the Invention

The present invention relates to an enclosed scroll compressor for use in refrigerators, air conditioners, and so on.

2. Description of the Related Art

FIG. 5 shows a vertical sectional view of a known scroll compressor. Referring to FIG. 5, in an upper portion of the interior of an enclosed container 101, there are disposed a compression mechanism 102 comprised of a fixed scroll 102*a* and a gyratory scroll 102*b* held in mesh with each other, a crankshaft 103 for driving the gyratory scroll 102*b*, an Oldham's ring 104 as a rotation preventing mechanism for converting the gyratory scroll 102*b* from rotating movement into gyrating movement, a thrust bearing 105 for supporting the thrust force of the gyratory scroll 102*b*, and a bearing part 106 comprised of a main bearing 106*a* and an auxiliary bearing 106*b* for jointly bearing the thrust bearing 105 and supporting the crankshaft 103. The fixed scroll 102*a* and the bearing part 106 are fastened together by bolts through a spacer 108. FIG. 6 shows assembled components around an eccentric bearing of the crankshaft in FIG. 5. An eccentric bearing 110 having an oil groove 109 formed therein and a leaf spring 111 are disposed in a hole 103*a* formed in an upper end of the crankshaft 103. A shaft 107 of the gyratory scroll 102*b* is inserted to the eccentric bearing 110 so that the gyratory scroll 102*b* is gyrated with rotation of the crankshaft 103 in the direction indicated by arrow A in FIG. 6. Further, in FIG. 5, a rotor 112*a* is attached to the crank-shaft 103 and makes up an electric motor 112 in cooperation with a stator 112*b* fixed to the enclosed container 101 by shrinkage fitting. The rotor 112*a* and the stator 112*b* are both disposed below the compression mechanism 102. An oil pump 113 is provided at a lower end of the crankshaft 103, and oil bores 115*a*, 115*b* are formed through the crankshaft 103 for introducing lubricating oil 114 pooled at the bottom of the enclosed container 101 from the oil pump 113 to upper sliding portions. The crankshaft 103 is supported by the main bearing 106*a* and the auxiliary bearing 106*b*. Attached to the enclosed container 101 are an intake pipe 118 for sucking a coolant through it and a delivery pipe 119 for discharging the coolant through it. These pipes 118, 119 are connected to an evaporator and a condenser (not shown), respectively, thereby constituting a generally known refrigerating cycle.

The oil pump 113 is generally a pump utilizing centrifugal force. The lubricating oil 114 is supplied to the sliding portions of the eccentric bearing 110, the main bearing 106*a*, the auxiliary bearing 106*b*, the thrust bearing 105, etc., which are disposed in the upper portion of the container space, under an action of centrifugal force produced by the oil pump 113 and in the oil bores 115*a*, 115*b* formed through the crankshaft 103.

In the above-described structure, however, upper spaces of oil paths (i.e., upper portions of the oil bores 115*a*, 115*b* and the hole 103*a* in the upper end of the crankshaft) are closed or left slightly open with respect to the inner space of the enclosed container. When the compressor is stopped, the upper spaces of the oil paths are filled with coolant gas. To start operation of the compressor and supply the lubricating oil to the sliding portions by sucking the oil by the oil pump 113 from that condition, the gas accumulated in the closed spaces of the oil bores 115*a*, 115*b* must be expelled out. The force for supplying the oil to the sliding portions is provided by the centrifugal force produced by the oil pump 113 and in the oil bores 115*a*, 115*b*. But, with the coolant gas filled in the oil bores 115*a*, 115*b*, sufficient centrifugal force cannot be produced. At the beginning of operation of the compressor, therefore, the accumulated gas is expelled out by insufficient force and, only after that, the oil is supplied to the sliding portions. This has raised a problem that supply of the oil to the sliding portions is delayed and a lubricating trouble such as a seizure may occur.

SUMMARY OF THE INVENTION

With the view of solving the above-mentioned problem in the related art, an object of the present invention is to promptly purge out coolant gas accumulated in oil paths and smoothly supply oil to sliding portions.

To achieve the above object, according to aspects of the present invention in an enclosed scroll compressor comprising a compression mechanism disposed in an upper portion of a space of an enclosed container and an oil pump provided at a lower end of a crankshaft for sucking up lubricating oil pooled at the bottom of the enclosed container, one or more oil bores are formed to extend through the crankshaft substantially in the axial direction in positions away from an axis of the crankshaft, and a radial bore is formed to extend from midway along each oil bore first substantially toward the axis of the crankshaft and then open to the space of the enclosed container.

Also, according to another aspect of the present invention, in the above enclosed scroll compressor, a plurality of oil bores are formed to extend through the crankshaft substantially in the axial direction in positions away from an axis of the crankshaft and spaced from each other circumferentially in the range of 90 degrees to 160 degrees, and radial bores are formed to extend from midway along the oil bores first substantially toward the axis of the crankshaft and then open to the space of the enclosed container.

According to still other aspects of the present invention, at least one of the radial bores is formed between a bearing supporting the crankshaft and an electric motor. According to still other aspects of the present invention, the positions of the radial bores are spaced from each other in the axial direction. According to still others aspects of the present invention, one of the oil bores is communicated with an eccentric bearing provided in the crankshaft and the other one or more oil bores are communicated with other sliding portions.

Further, according to still another aspect of the present invention, in the above enclosed scroll compressor, a plurality of oil bores are formed to extend through the crankshaft substantially in the axial direction in positions away from an axis of the crankshaft, one of the oil bores being communicated with the eccentric bearing, another oil bore being communicated with the bearing supporting the crankshaft, and the positions of the oil bores are spaced an angle less than 180° from each other in the circumferential direction so that the oil bores are located close to respective oil grooves formed to lubricate the eccentric bearing and the crankshaft bearing. According to still another aspect of the present invention, radial bores are formed to extend from midway along the oil bores first substantially toward the axis of the crankshaft and then open to the space of the enclosed container.

With the construction defined above, at start-up of the compressor, coolant gas accumulated in the oil bore can be smoothly expelled out into the space of the enclosed container through the radial bore with the oil sucked up by the oil pump and rising in the oil bore. When the sucked oil reaches a position near the radial bore, an action of centrifugal force prevents the oil from flowing out into the space of the enclosed container through the radial bore, because the radial bore is formed to extend substactially toward the axis of the crankshaft before opening to the container space. The oil can be thereby quickly and surely supplied to the sliding portion.

When a plurality of oil bores are provided to purge out the gas therethrough independently of each other, the possibility that the gas may stagnate midway oil paths leading to the sliding portions is reduced. Therefore, the oil can be more quickly and surely supplied to the sliding portions.

By forming a plurality of oil bores in positions spaced from each other circumferentially in the range of 90 degrees to 160 degrees, the radial bores extending from midway along the oil bores first substantially toward the axis and then opening to the space of the enclosed container can be easily formed without interfering with the oil bores. Further, when a plurality of oil bores are spaced an angle less than 180° from each other in the circumferential direction the opening of one oil bore can be located close to an oil groove formed in the eccentric bearing offset away from the direction in which the load is directly applied, and the opening of anther oil bore can be located close to an oil groove formed in a position corresponding to part of the crankshaft bearing opposed to the side to which the load is directly applied. As a result, the oil coming out of the oil bores can be smoothly supplied to the sliding portions of both the bearings.

With the various constructions defined above, the gas can be smoothly expelled out into the space of the enclosed container without being blocked off by the other sliding portions and the electric motor, the gases passing through the radial bores can be expelled out into the space of the enclosed container without interfering with each other, and the oil rising in the oil bores can be quickly and surely supplied to the sliding portions.

As stated above, in the enclosed scroll compressor of the present invention, since at least one oil bore is formed to extend through the crankshaft substantially in the axial direction in a position away from an axis of the crankshaft, and a radial bore is formed to extend from midway the oil bore first substantially toward the axis of the crankshaft and then open to the space of the enclosed container, the coolant gas accumulated in the oil bore can be smoothly expelled out into the space of the enclosed container through the radial bore. Also, when the sucked oil reaches a position near the radial bore, an action of centrifugal force prevents the oil from flowing out into the space of the enclosed container through the radial bore, because the radial bore is formed to extend substantially toward the axis of the crankshaft before opening to the container space. It is thus possible to realize a compressor with high reliability in which the oil can be quickly and surely supplied to the sliding portion.

With the radial bore positioned between the electric motor and the crankshaft bearing, the coolant gas accumulated in the oil bore can be smoothly expelled out into the space of the enclosed container through the radial bore. This feature contributes to realizing a compressor with high reliability in which the oil can be quickly and surely supplied to the sliding portion.

Also, since the plurality of oil bores are provided to purge out the gas therethrough independently of each other, the possibility that the gas may stagnate midway along the oil paths leading to the sliding portions is reduced. Therefore, the oil can be more quickly and surely supplied to the sliding portions, resulting in a compressor with higher reliability.

Further, since the plurality of oil bores are formed to extend through the crankshaft substantially in the axial direction in the positions away from the axis of the crankshaft and spaced from each other circumferentially in the range of 90 degrees to 160 degrees, and the radial bores are formed to extend from midway the oil bores first substantially toward the axis of the crankshaft and then open to the space of the enclosed container, the radial bores can be easily formed without interfering mutually. In addition, with the radial bores positioned between the electric motor and the crankshaft bearing, the coolant gas accumulated in the oil bores can be smoothly expelled out into the space of the enclosed container through the radial bores. It is thus possible to realize a compressor with high reliability in which the oil can be quickly and surely supplied to the sliding portion.

Furthermore, since the plurality of oil bores are formed to extend through the crankshaft substantially in the axial direction in the positions away from the axis of the crankshaft, one of the oil bores being communicated with the eccentric bearing, another oil bore being communicated with the bearing supporting the crankshaft, and the positions of the oil bores are spaced an angle less than 180° from each other in the circumferential direction so that the oil bores are located close to the respective oil grooves formed to lubricate the eccentric bearing and the crankshaft bearing, the oil coming out of the oil bores can be smoothly supplied to the sliding portions of both the eccentric bearing and the crankshaft bearing (main bearing), resulting in a compressor with high reliability.

PREFERRED EMBODIMENTS OF THE INVENTION

Figure 1:
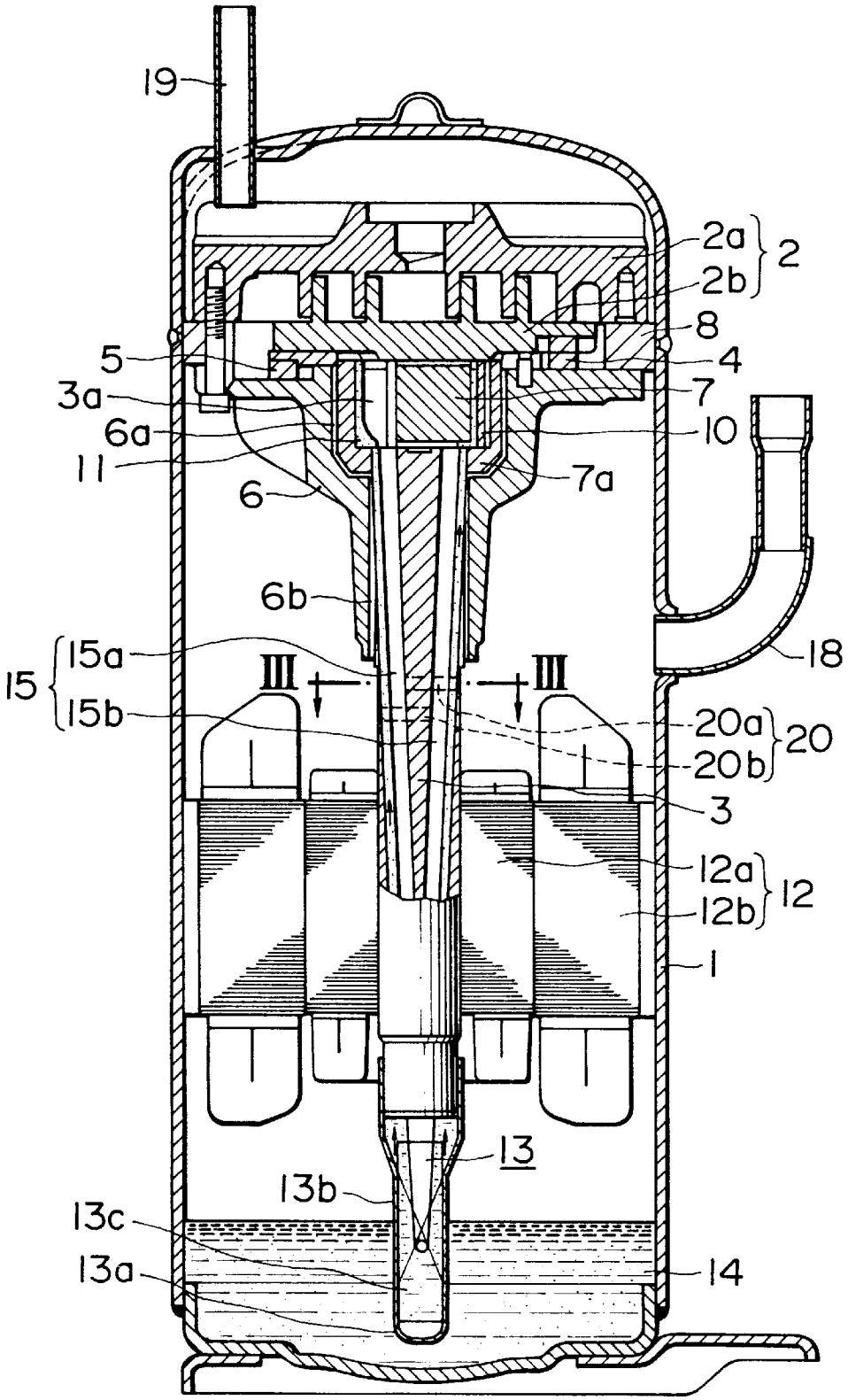
FIG. 1 is a vertical sectional view of a scroll compressor according to one embodiment of the present invention.
Figure 2:
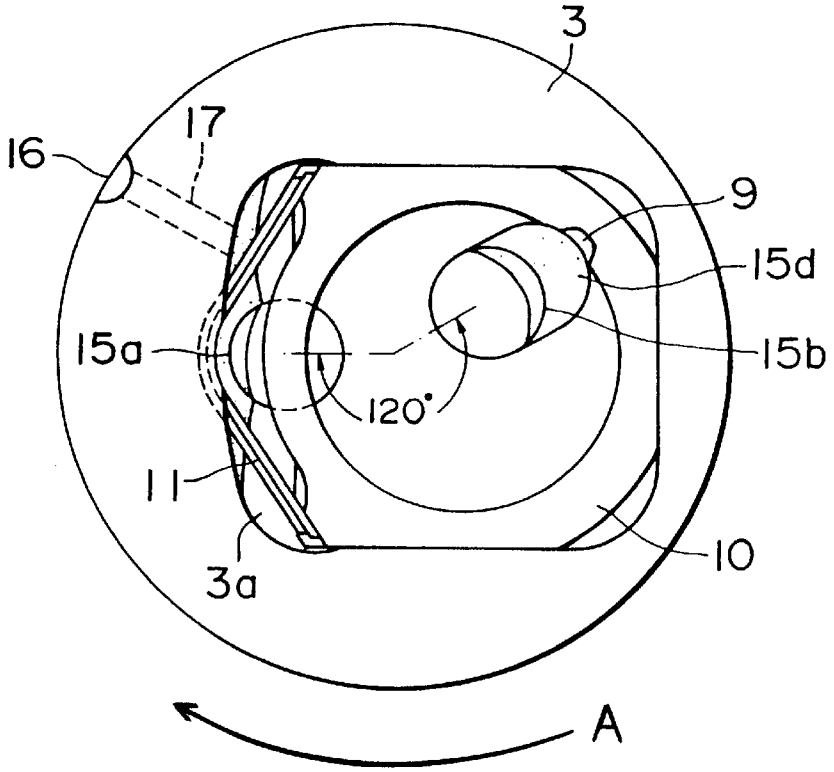
FIG. 2 is an assembly view of components around an eccentric bearing of a crankshaft in FIG. 1.
Figure 3:
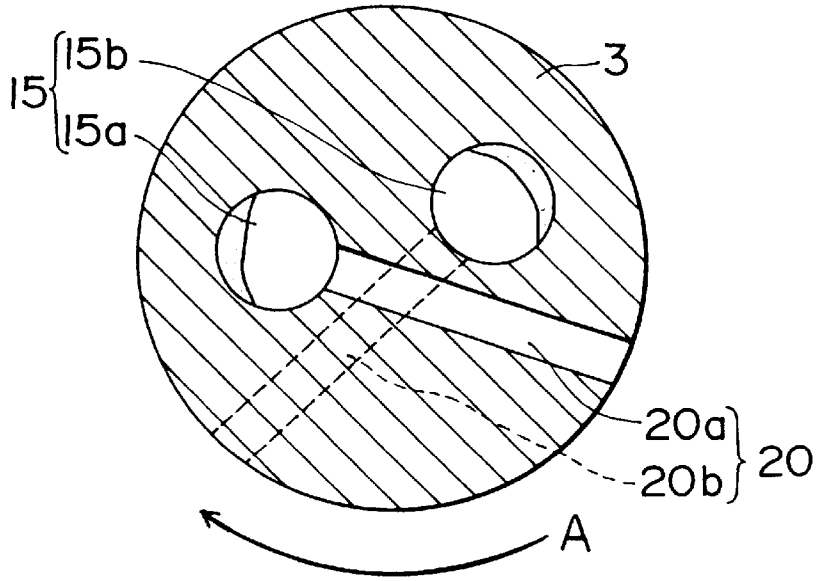
FIG. 3 is a horizontal sectional view of the crankshaft taken along line III—III in FIG. 1.
Figure 4:
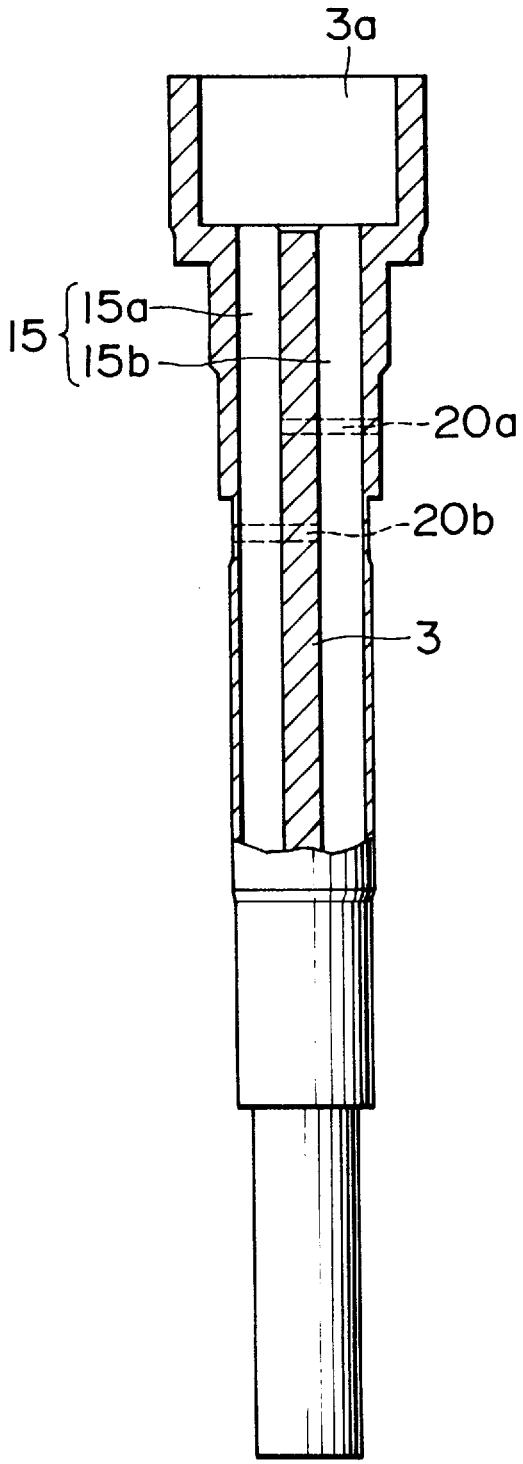
FIG. 4 is a vertical sectional view of a crank-shaft according to another embodiment of the present invention.
Figure 5:
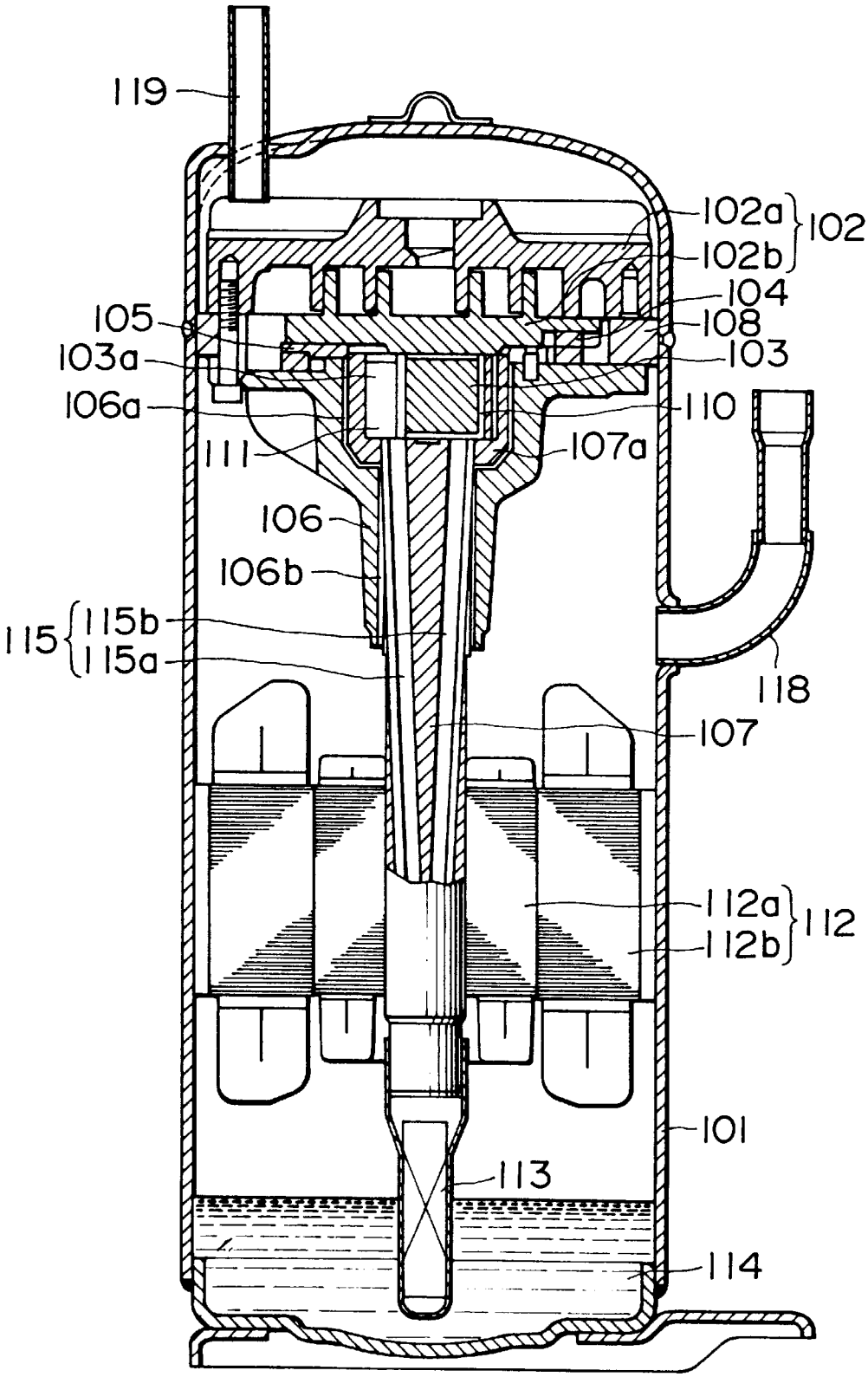
FIG. 5 PRIOR ART
FIG. 5 is a vertical sectional view of a prior art scroll compressor.

Preferred embodiments of the present invention will be described hereunder with reference to FIGS. 1 to 4. FIG. 1 is a vertical sectional view of a scroll compressor according to one embodiment of the present invention, FIG. 2 is an assembly view of components around an eccentric bearing of a crankshaft 3, FIG. 3 is a horizontal sectional view of the crankshaft 3 taken along line III—III in FIG. 1, and FIG. 4 is a vertical sectional view of a crankshaft 3 according to another embodiment.

Referring to FIG. 1, in an upper portion of the interior of an enclosed container 1, there are disposed a compression mechanism 2 comprised of a fixed scroll 2*a* and a gyratory scroll 2*b* held in mesh with each other, a crankshaft 3 for driving the gyratory scroll 2*b*, an Oldham's ring 4 as a rotation preventing mechanism for converting the gyratory scroll 2*b* from rotating movement into gyrating movement, a thrust bearing 5 for supporting the thrust force of the gyratory scroll 2*b*, and a bearing part 6 comprised of a main bearing 6*a* and an auxiliary bearing 6*b* for jointly bearing the thrust bearing 5 and supporting the crankshaft 3. The fixed scroll 2*a* and the bearing part 6 are fastened together by bolts through a spacer 8. FIG. 2 shows assembled components around an eccentric bearing of the crankshaft 3. An eccentric bearing 10 having an oil groove 9 formed therein and a leaf spring 11 are disposed in a hole 3*a* formed in an upper end of the crankshaft 3. A shaft 7 of the gyratory scroll 2*b* is inserted to the eccentric bearing 10 so that the gyratory scroll 2*b* is gyrated with rotation of the crankshaft 3. Further, in FIG. 1, a rotor 12*a* is attached to the crankshaft 3 and makes up an electric motor 12 in cooperation with a stator 12*b* fixed to the enclosed container 1 by shrinkage fitting. The rotor 12*a* and the stator 12*b* are both disposed below the compression mechanism 2. Attached to the enclosed container 1 are an intake pipe 18 for sucking a coolant through it and a delivery pipe 19 for discharging the coolant through it. These pipes 18, 19 are connected to an evaporator and a condenser (not shown), respectively, thereby constituting a generally known refrigerating cycle.

Oil paths will now be described. An oil pump 13 is provided at a lower end of the crankshaft 3. The oil pump 13 is of centrifugal type and comprises a tubular oil cock 13*b* having one end fixed to the lower end of the crankshaft 3 and the other end formed with an opening 13*a*, and an oil vane 13*c* formed of a twisted flat plate and inserted to the oil cock 13*b*. A distal end of the oil cock 13*b* is immersed in lubricating oil 14 pooled at the bottom of the enclosed container. Two oil bores 15*a*, 15*b* are formed so as to penetrate the crankshaft 3 from the lower end to which the oil pump is attached, to the hole 3*a* formed in the upper end. The oil bores 15*a*, 15*b* are formed such that they are axially inclined to some extent and spaced a larger distance away from the axis as coming closer to the hole 3*a*. Rather than being inclined, the oil bores may be formed straight in the axial direction, as shown in FIG. 4. FIG. 3 is a horizontal sectional view of the crankshaft 3 taken along line III—III in FIG. 1. As shown in FIG. 3, the oil bores 15*a*, 15*b* are formed in positions away from the center (axis) of the crankshaft 3 and being not symmetrical about the center, but spaced an angle of about 120° from each other in the circumferential direction. Radial bores 20*a*, 20*b* communicating with the oil bores 15*a*, 15*b*, respectively, are formed in a middle portion of the crankshaft 3 between the bearing part 6 and the rotor 12*a* of the electric motor. The radial bores 20*a*, 20*b* are formed in positions vertically spaced from each other and, as shown in FIG. 3, extend from the oil bores 15*a*, 15*b* first substantially toward the axis and then open to the closed space of the container. One oil bore 15*b* is opened to the hole 3*a* at the bottom of the eccentric bearing 10. As seen from the assembly view of an upper portion of the crankshaft shown in FIG. 2, the open end of the oil bore 15*b* is located slightly away from the eccentric direction of the eccentric shaft 10 toward the oil groove 9 formed in the eccentric bearing 10. A groove 15*d* is formed in the bottom of the bore 3*a* to extend between the oil groove 9 in the eccentric bearing 10 and the open end of the oil bore 15*b*. The other oil bore 15*a* is opened to the hole 3*a* in a position away from the axis of the crankshaft opposed 180° to the eccentric direction of the eccentric shaft 10. Accordingly, the open end of the oil bore 15*a* is spaced an angle of about 120° from the open end of the oil bore 15*b* in the circumferential direction. The open end of the oil bore 15*a* is communicated via a bore 17 with an oil groove 16 formed in part of an outer wall of the crankshaft which defines the hole 3*a*.

Figure 6:
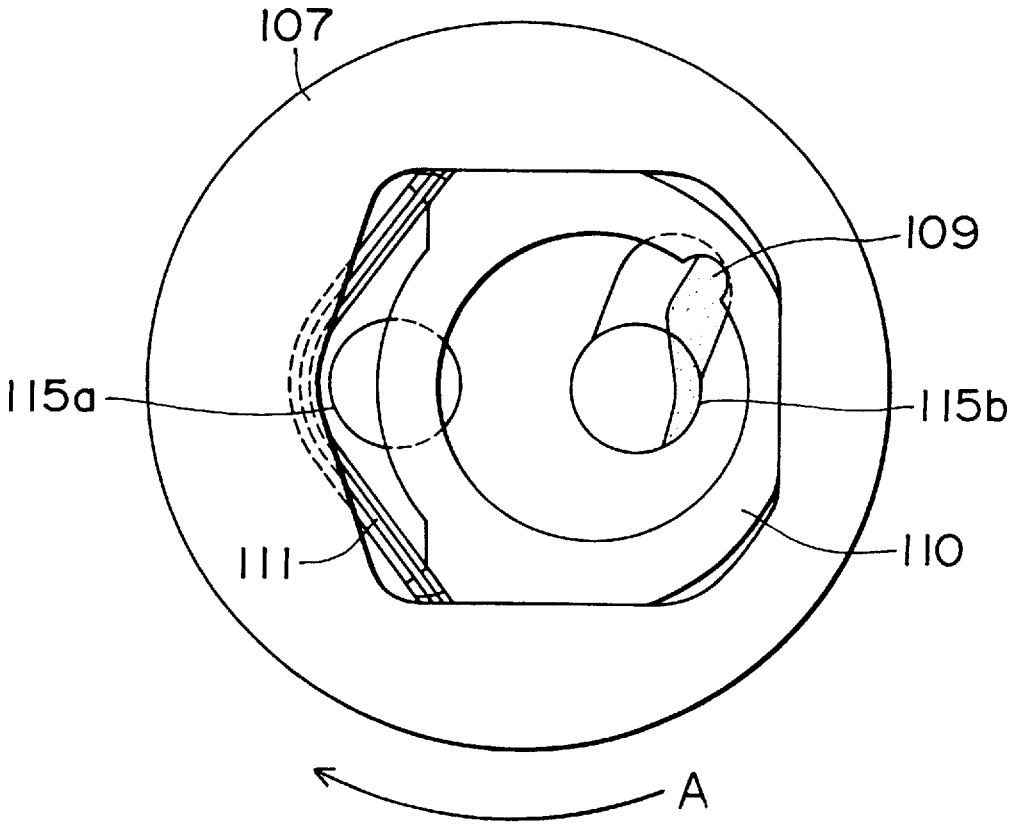
FIG. 6 PRIOR ART
FIG. 6 is an assembly view of components around an eccentric bearing of a crankshaft of the prior art scroll compressor.

The operation of the thus-constructed compressor at start-up will be described below primarily in connection with supply of the oil to sliding portions. When the compressor is stopped, the oil 14 is pooled at the bottom of the enclosed container 1. The upper portion of the compressor is filled with coolant gas and, therefore, the coolant gas is also filled in the oil bores 15*a*, 15*b* formed through the crankshaft 3 and the hole 3*a* formed in the upper end of the crankshaft 3. When the compressor starts rotation in the direction indicated by arrow A in FIGS. 2 and 3, the oil in the oil cock 13*b* is rotated by the oil vane 13*c* and given centrifugal force. Under an action of the centrifugal force, the oil is sucked from the opening 13*a* at the distal end of the oil cock 13*b* and then rises in the oil bores 15*a*, 15*b*. At this time, the oil pushes the coolant gas initially accumulated in the oil bores 15*a*, 15*b*. The pushed coolant gas is expelled out into the space of the enclosed container through the radial bores 20*a*, 20*b*. This enables the oil to continue ascending, i.e., to further rise along outer peripheral surfaces of the oil bores. Since the oil bores are slightly inclined outward relative to the axis of the crankshaft as approaching the upper end, the oil is given larger centrifugal force while rising in the oil bores. The oil reaching the level of the radial bores 20*a*, 20*b* does not flow out through the radial bores because the oil rises along wall surfaces of the oil bores on the side opposite to the radial bores 20*a*, 20*b* as shown in FIG. 3. After further continuing ascent, the oil having passed the oil bore 15*b* reaches below the eccentric bearing 10 and is supplied to the oil groove 9 in the eccentric bearing 10 through the groove 15*d* formed at the bottom of the hole 3*a*, as shown in FIG. 3, thereby lubricating the sliding portion of the eccentric bearing 10. Since the oil bore 15*b* is offset away from the direction in which the load is directly applied, the oil groove 9 and the open end of the oil bore 15*b* are located close to each other so that the oil can be smoothly supplied to the oil groove 9 straightforward. This means that the oil does not flow obliquely unlike the prior art in which the oil flows obliquely from the position of the oil bore 115*b* toward the oil groove 109 as shown in FIG. 6, and the oil is surely supplied to the eccentric bearing 10. On the other hand, the oil bore 15*a* is opened in a position away from the axis of the crankshaft opposed to the eccentric direction of the eccentric shaft 10, and the oil coming out of the oil bore 15*a* is supplied through the bore 17 to the oil groove 16 formed in a position corresponding to part of the main bearing 6*a* opposed to the side to which the load is directly applied, thereby lubricating the sliding portion of the main bearing 6*a*. Furthermore, the oil flooding out over the hole 3*a* lubricates the thrust bearing and the Oldham's ring 4.

With the construction described above, at start-up of the compressor, the coolant gas accumulated in the oil bores can be smoothly expelled out into the space of the enclosed container through the radial bores. Also, when the sucked oil reaches a position near the radial bores, an action of centrifugal force prevents the oil from flowing out into the space of the enclosed container through the radial bores, because the radial bores are formed to extend substantially toward the axis of the crankshaft before opening to the container space. The oil can be thereby quickly and surely supplied to the sliding portion. As a result, it is possible to prevent a seizure damage of the sliding portion which would be otherwise caused due to a delay in supply of the oil, and to realize a compressor with high reliability.

Also, since the oil bores are provided for the main bearing and the eccentric bearing independently of each other, the possibility that the gas may stagnate midway along the oil paths is reduced in comparison with the case where the oil bores would be communicated with the bearings in series. Further, since the oil bores have respective gas purge bores formed to extend therefrom, the gas can be smoothly purged out of the oils bores. As a result, the oil can be quickly and surely supplied to the sliding portions and a compressor with high reliability can be realized.

While the foregoing description has been made on the start-up stage of the compressor, similar advantages can also be achieved when a sudden change in pressure occurs in the compressor. Specifically, upon a sudden change in pressure, coolant gas dissolved in the oil may often evaporate and the evaporated coolant gas may stagnate in the oil paths, thus inviting a reduction in capacity of the oil pump and a failure of lubrication to the sliding portions. However, since the generated gas can be smoothly expelled out even in such a case, the above problems can also be prevented.

If the radial bores are positioned at a too low level, the effect of purging the gas could not be developed for the gas existing in portions above that level. Conversely, if the radial bores are positioned at a too high level, there could occur a phenomenon that the oil and the gas are accumulated alternately in portions below that level. Further, if the radial bores positioned within the bearing part 6, i.e., between the main bearing 6*a* and the auxiliary bearing 6*b*, it would be required to form a gas urge bore in the bearing part 6. Accordingly, the gas can be most smoothly purged out by positioning the radial bores between the electric motor and the bearing part.

FIG. 3 is a horizontal sectional view of the crankshaft 3. The oil bores 15*a*, 15*b* shown in FIG. 3 are formed in positions spaced approximately 120° from each other in the circumferential direction about the axis. By forming the oil bores in positions spaced from each other in the range of 90° to 160°, however, the radial bores extending from midway along the oil bores first substantially toward the axis and then opening to the space of the enclosed container can be formed so as to pass the axis or thereabout. This means that when the radial bores are formed by drilling from the outer circumferential surface of the crankshaft, a drill can be applied to the outer circumferential surface at a right angle, the shaft wall can be bored with no need of any pre-working, and hence the drilling can be more simply performed. Further, by spacing the radial bores from each other in the above range, the radial bore extending from one oil bore is kept from interfering with the other oil bore. Additionally, by forming the radial bores in vertically spaced relation, the radial bores can be prevented from interfering with each other. The vertically spaced arrangement of the radial bores is also effective in not reducing the strength of the crankshaft.

Furthermore, in the construction described above, the oil bores are spaced an angle less than 180° from each other in the circumferential direction so that the open end of one oil bore can be located close to the oil groove formed in the eccentric bearing offset away from the direction in which the load is directly applied, and the open end of the other oil bore can be located close to the oil groove formed in the position corresponding to part of the crankshaft bearing opposed to the side to which the load is directly applied. As a result, a compressor with high reliability can be realized in which the oil coming out of the oil bores can be smoothly supplied to the sliding portions of both the eccentric bearing and the main bearing.

While the oil pump has been described above as being of a centrifugal type, similar advantages can also be achieved in the case of using a displacement oil pump such as a trochoid pump.

What is claimed is:

1. A scroll compressor comprising:

an enclosed container which encloses a space;

a compression mechanism housed in said enclosed container and comprising a first scroll and a second scroll held in mesh with each other to define a plurality of compression spaces, said compression mechanism being disposed in said space of said container;

a crankshaft including an eccentric bearing to drive said second scroll, said crankshaft having an axis which defines an axial direction;

a bearing for supporting said crankshaft;

a motor attached to said crankshaft; and an oil pump provided at an end of said crankshaft for sucking up oil pooled in said enclosed container;

wherein a plurality of oil bores are formed to extend through said crankshaft substantially in the axial direction in positions away from said axis of said crankshaft, and radial bores are formed to extend from midway along said oil bores substantially toward the axis of said crankshaft and then open to the space of said enclosed container.

2. A scroll compressor according to claim 1, wherein one of said oil bores is communicated with said eccentric bearing and the other one or more oil bores are communicated with other sliding portions.

3. A scroll compressor according to claim 1, wherein the first scroll is a fixed scroll and the second scroll is a gyratory scroll.

4. A scroll compressor according to claim 1, wherein said compression mechanism is housed in an upper portion of said space of said enclosed container.

5. A scroll compressor according to claim 1, wherein said motor is an electric motor.

6. A scroll compressor according to claim 1, wherein:

said oil is pooled at a bottom of said enclosed container; and said oil pump is provided at a lower end of said crankshaft.

7. A scroll compressor according to claim 1, wherein at least one of said radial bores is formed between said bearing for supporting said crankshaft and said motor.

8. A scroll compressor according to claim 7, wherein one of said oil bores is communicated with said eccentric bearing and the other one or more oil bores are communicated with other sliding portions.

9. A scroll compressor according to claim 7, wherein the positions of said radial bores are spaced from each other in the axial direction.

10. A scroll compressor according to claim 9, wherein one of said oil bores is communicated with said eccentric bearing and the other one or more oil bores are communicated with other sliding portions.

11. A scroll compressor according to claim 1 wherein the positions of said radial bores are spaced from each other in the axial direction.

12. A scroll compressor according to claim 11, wherein one of said oil bores is communicated with said eccentric bearing and the other one or more oil bores are communicated with other sliding portions.

13. A scroll compressor comprising:

an enclosed container which encloses a space;

a compression mechanism housed in said enclosed container and comprising a first scroll and a second scroll held in mesh with each other to define a plurality of compression spaces, said compression mechanism being disposed in said space of said container;

a crankshaft including an eccentric bearing to drive said second scroll, said crankshaft having an axis which defines an axial direction;

a bearing for supporting said crankshaft;

a motor attached to said crankshaft; and an oil pump provided at an end of said crankshaft for sucking up oil pooled in said enclosed container;

wherein a plurality of oil bores are formed to extend through said crankshaft substantially in the axial direction in positions away from said axis of said crankshaft and spaced from each other circumferentially in a range of 90 degrees to 160 degrees, and radial bores are formed to extend from midway along said oil bores substantially toward the axis of said crankshaft and then open to the space of said enclosed container.

14. A scroll compressor according to claim 13 wherein one of said oil bores is communicated with said eccentric bearing and the other one or more oil bores are communicated with other sliding portions.

15. A scroll compressor according to claim 13, wherein the first scroll is a fixed scroll and the second scroll is a gyratory scroll.

16. A scroll compressor according to claim 13, wherein said compression mechanism is housed in an upper portion of said space of said enclosed container.

17. A scroll compressor according to claim 13, wherein said motor is an electric motor.

18. A scroll compressor according to claim 13, wherein:

said oil is pooled at a bottom of said enclosed container; and said oil pump is provided at a lower end of said crankshaft.

19. A scroll compressor according to claim 13, wherein at least one of said radial bores is formed between said bearing for supporting said crankshaft and said motor.

20. A scroll compressor according to claim 19, wherein one of said oil bores is communicated with said eccentric bearing and the other one or more oil bores are communicated with other sliding portions.

21. A scroll compressor according to claim 19, wherein the positions of said radial bores are spaced from each other in the axial direction.

22. A scroll compressor according to claim 21, wherein one of said oil bores is communicated with said eccentric bearing and the other one or more oil bores are communicated with other sliding portions.

23. A scroll compressor according to claim 13 wherein the positions of said radial bores are spaced from each other in the axial direction.

24. A scroll compressor according to claim 23, wherein one of said oil bores is communicated with said eccentric bearing and the other one or more oil bores are communicated with other sliding portions.

25. A scroll compressor comprising:

an enclosed container which encloses a space; for containing a pool of oil a compression mechanism housed in said enclosed container and comprising a first scroll and a second scroll held in mesh with each other to define a plurality of compression spaces;

a crankshaft including an eccentric bearing to drive said second scroll, said eccentric bearing having an oil groove for carrying oil, said oil groove being formed offset away from a direction in which a load is directly applied, said crankshaft having an axis which defines an axial direction and a circumferential direction;

a bearing for supporting said crankshaft; and a motor attached to said crankshaft;

wherein a plurality of oil bores for carrying said oil are formed to extend through said crankshaft substantially in the axial direction in positions away from said axis of said crankshaft, one of said oil bores being communicated with said eccentric bearing, another oil bore being communicated with said bearing for supporting said crankshaft, and positions of said oil bores are spaced an angle less than 180° from each other in the circumferential direction so that said oil bores are located respectively close to the oil groove formed in said eccentric bearing and an oil groove formed to carry said oil to lubricate said crankshaft bearing.

26. A scroll compressor according to claim 25, wherein radial bores are formed to extend from midway along said oil bores substantially toward the axis of said crankshaft and then open to the space of said enclosed container.

27. A scroll compressor according to claim 25, wherein the first scroll is a fixed scroll and the second scroll is a gyratory scroll.

28. A scroll compressor according to claim 25, wherein said motor is an electric motor.

* * * * *